US006520794B2

(12) United States Patent
Liao

(10) Patent No.: US 6,520,794 B2
(45) Date of Patent: Feb. 18, 2003

(54) RECEPTACLE HAVING STRUCTURE CONVENIENTLY IN ASSEMBLY

(76) Inventor: Sheng Hsin Liao, No. 10, Alley 38, Lane 229, San Chun St., Shulin, Taipei Hsien (TW)

( * ) Notice: Subject to any disclaimer, the term of this patent is extended or adjusted under 35 U.S.C. 154(b) by 0 days.

(21) Appl. No.: 09/737,463

(22) Filed: Dec. 18, 2000

(65) Prior Publication Data

US 2002/0064991 A1 May 30, 2002

(30) Foreign Application Priority Data

Nov. 29, 2000 (TW) ..... 89220741 U

(51) Int. Cl.[7] ..... H01R 11/20

(52) U.S. Cl. ..... 439/418; 439/456; 439/404; 439/676

(58) Field of Search ..... 439/418, 419, 439/456, 457, 459, 695, 404, 676

(56) References Cited

U.S. PATENT DOCUMENTS 4,875,875 A * 10/1989 Archer et al. ..... 439/401
5,830,005 A * 11/1998 Watanabe ..... 439/418
6,319,048 B1 * 11/2001 Aekins et al. ..... 439/418

* cited by examiner

*Primary Examiner*—Tho D. Ta
*Assistant Examiner*—Truc Nguyen
(74) *Attorney, Agent, or Firm*—Rosenberg, Klein & Lee

(57) ABSTRACT

A receptacle having a structure conveniently in assembly includes a main body, terminals, a connector and leads. A receiving chamber is installed in the main body. A front end of the main body is installed with a plurality of terminal grooves A hollow cover is formed at the rear end of the connector. A plurality of wire grooves are installed at the front end of the connector. The lateral walls of the wire grooves are opened. The leads pass through the hollow cover of the connector and then placed in the wire grooves so that the leads are connected to the connector. The connectors are buckled and fixed within the receiving chamber of the main body. The terminals are pressed into the terminal grooves so that the terminals pierce into the leads and thus the terminals are electrically connected to the leads.

4 Claims, 9 Drawing Sheets

RECEPTACLE HAVING STRUCTURE CONVENIENTLY IN ASSEMBLY

FIELD OF THE INVENTION

The present invention relates to a receptacle, and especially to a receptacle having a structure conveniently in assembly, so as to reduce the manufacturing cost,

BACKGROUND OF THE INVENTION

A receptacle for electrically connecting with a plurality of leads is illustrated in FIG. 1. The receptacle is suitable for being connected to the wires of a computer or a phone. The top of the main body 10*a* of the receptacle is installed with an elastomer 11*a*. The bottom in the main body 10*a* is installed with a plurality of terminals 12*a*. The terminals 12*a* may move longitudinally. A top of the terminal 12*a* is installed with a connector 13*a* in the main body 10*a*. The connector 13*a* has a plurality of rectangular grooves 14*a* for being communicating with outer environment. The position of the opening of the rectangular groove 14*a* is correspondent to the terminal 12*a* of the main body 10*a*. Thereby, the terminals 12*a* passes through the rectangular grooves 14*a* to the connector 13*a* and a plurality of guide grooves (not shown) are formed in the connector 13*a*.

When a plurality of leads 20*a* are desired to be inserted into the receptacle, the leads 20 are inserted from the rear end of the main body 10*a* so that the leads 20*a* are inserted into the guide grooves in the connector 13*a*. Thereby, the terminals 12*a* passes through the rectangular grooves 14*a* to the connector 13*a* and the terminals 12*a* pierce the leads 20*a* so that the terminals 12*a* are electrically connected to the conductor within the leads 20*a*.

However, in the prior art receptacle, the leads 20*a* are inserted from the rear end of the main body 10*a,* so that the leads 20*a* are inserted into the guide grooves in the connector 13*a* since the connector 13*a* is fixed to the deep inner portion of the main body 10*a* and the leads are made of slender and soft material. It is very hard to align the lead and the wire groove in the connector. As a result, the assembly work is inconvenient.

SUMMARY OF THE INVENTION

Accordingly, the primary object of the present invention is to provide a receptacle having a structure conveniently in assembly, in which the leads are connected with the connector in advance so that the leads are connected with the connector external the main body. Then the connector pulls the leads into the main body so as to be electrically connected to the terminals. By this special design, the assembly work is easy with less work and cost. The product cost is low and is economical.

Another object of the present invention is to provide a receptacle having a structure conveniently in assembly, in which near a rear end of the receiving chamber of the main body has a buckle and a correspondent positioning groove; the buckle is pushed inwards so as to push a respective portions on the leads to move into the positioning groove so that the lead is clamped between the buckle and the positioning groove. Furthermore, the portion of a lead with respect to the buckle and positioning groove is distorted for preventing to release from the main body or the connector due to an outer force applied thereon.

To achieve the objects, the present invention provides a receptacle having a structure conveniently in assembly comprising a main body, terminals, a connector and leads. A receiving chamber is installed in the main body. A front end of the main body is installed with a plurality of terminal grooves. The terminal grooves are communicated with the receiving chamber. The terminals are placed in the terminal grooves of the main body. A hollow cover is formed at the rear end of the connector. A plurality of wire grooves are installed at the front end of the connector. The lateral walls of the wire grooves are opened. The leads pass through the hollow cover of the connector and then placed in the wire grooves so that the leads are connected to the connector. The connectors are buckled and fixed within the receiving chamber of the main body. The terminals are pressed into the terminal grooves so that the terminals pierce into the leads and thus the terminals are electrically connected to the leads. Thereby, a receptacle having a structure conveniently in assembly is formed.

The various objects and advantages of the present invention will be more readily understood from the following detailed description when read in conjunction with the appended drawing.

DETAILED DESCRIPTION OF THE PREFERRED EMBODIMENTS

Figure 1:
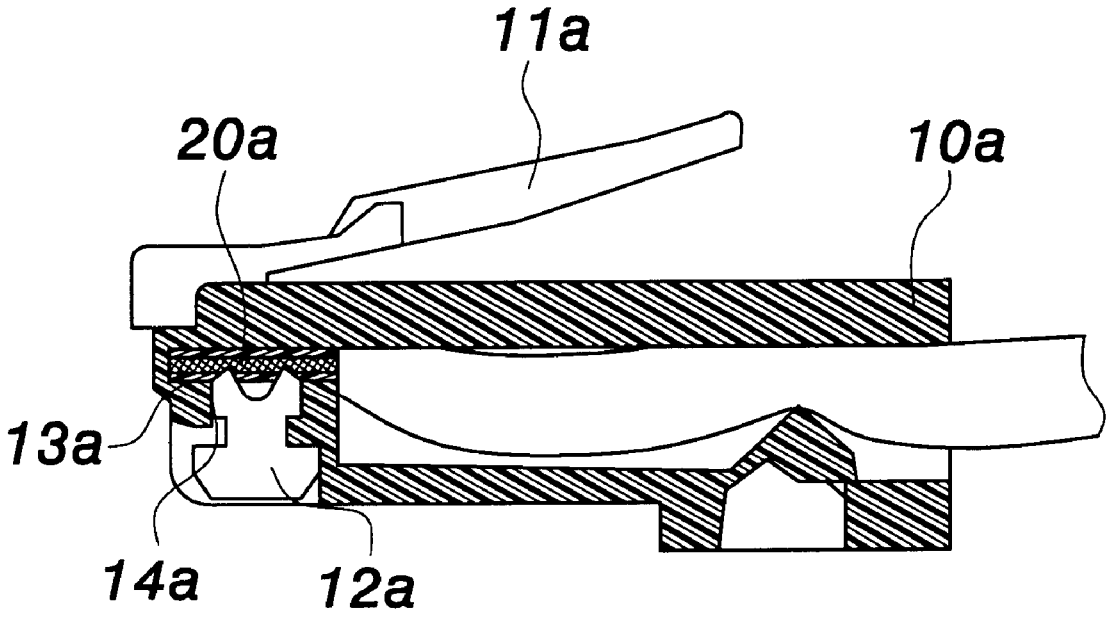
FIG. 1 PRIOR ART
FIG. 1 is a cross sectional view of a prior art receptacle.
Figure 2:
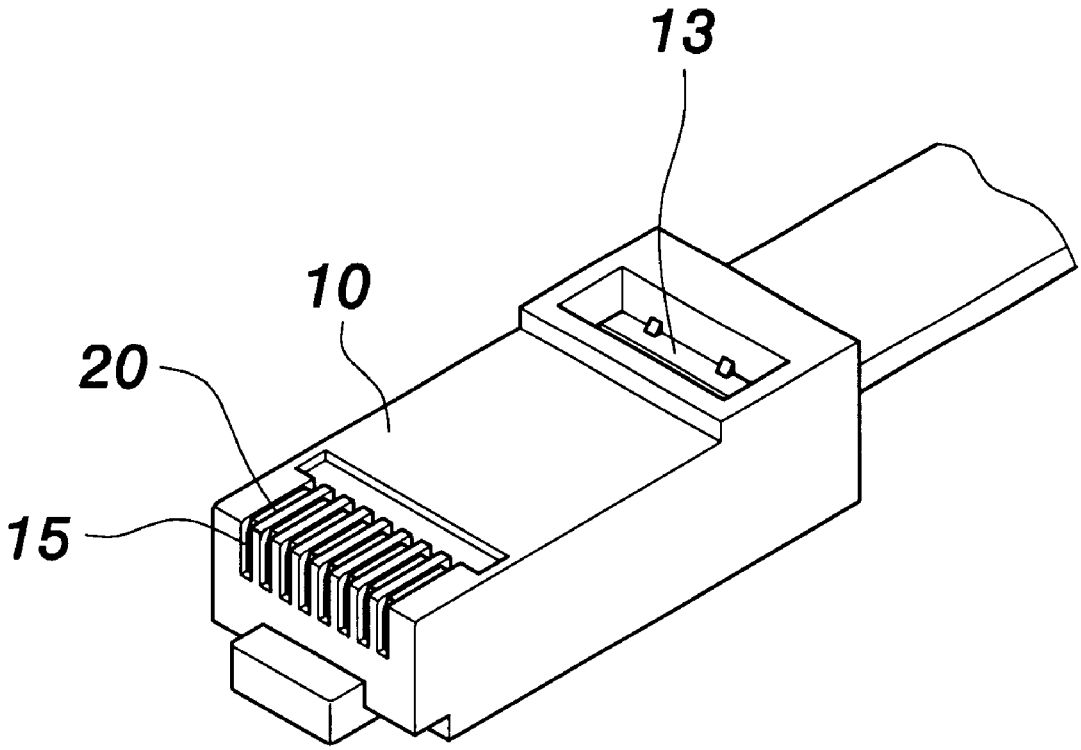
FIG. 2 is an assembled perspective view of the present invention.
Figure 3:
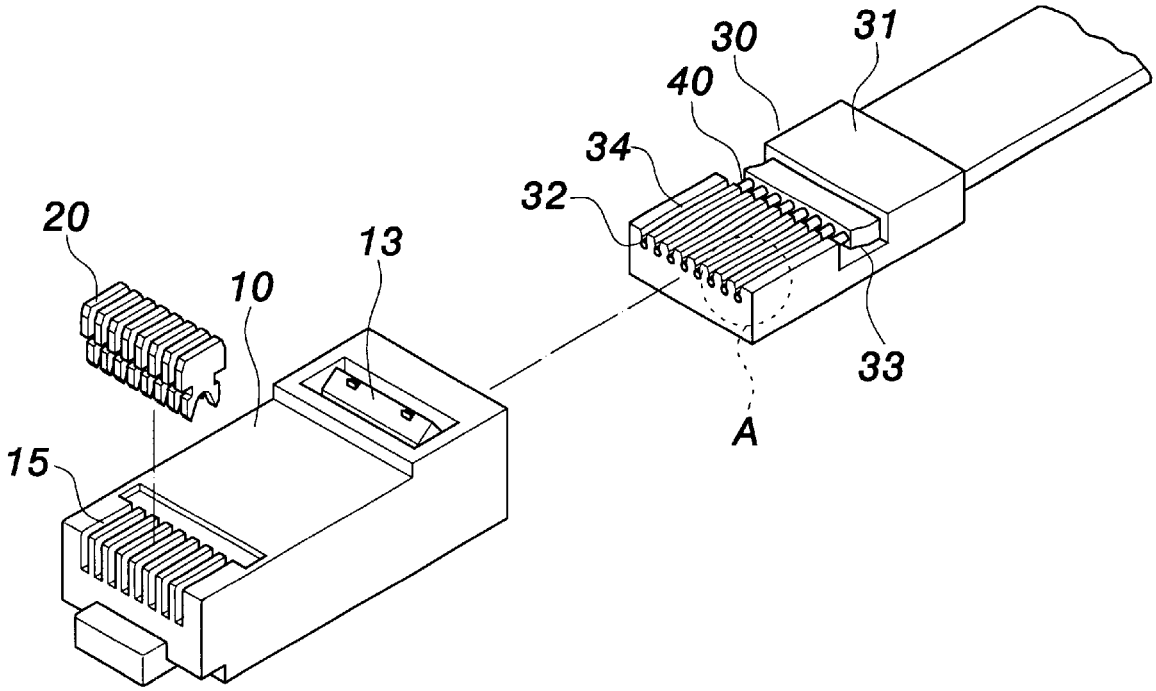
FIG. 3 is an exploded perspective view of the present invention.
Figure 3A:
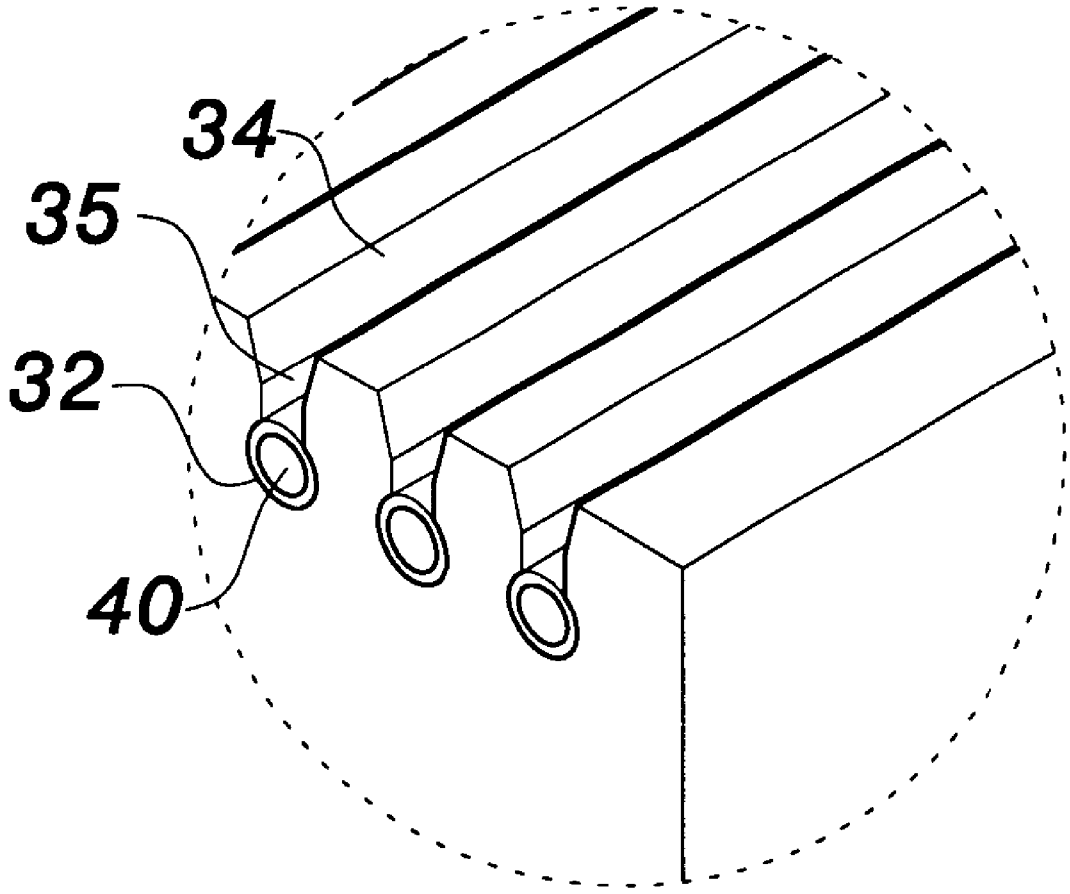
FIG. 3A is a partial enlarged view of part A in FIG. 3.
Figure 4:
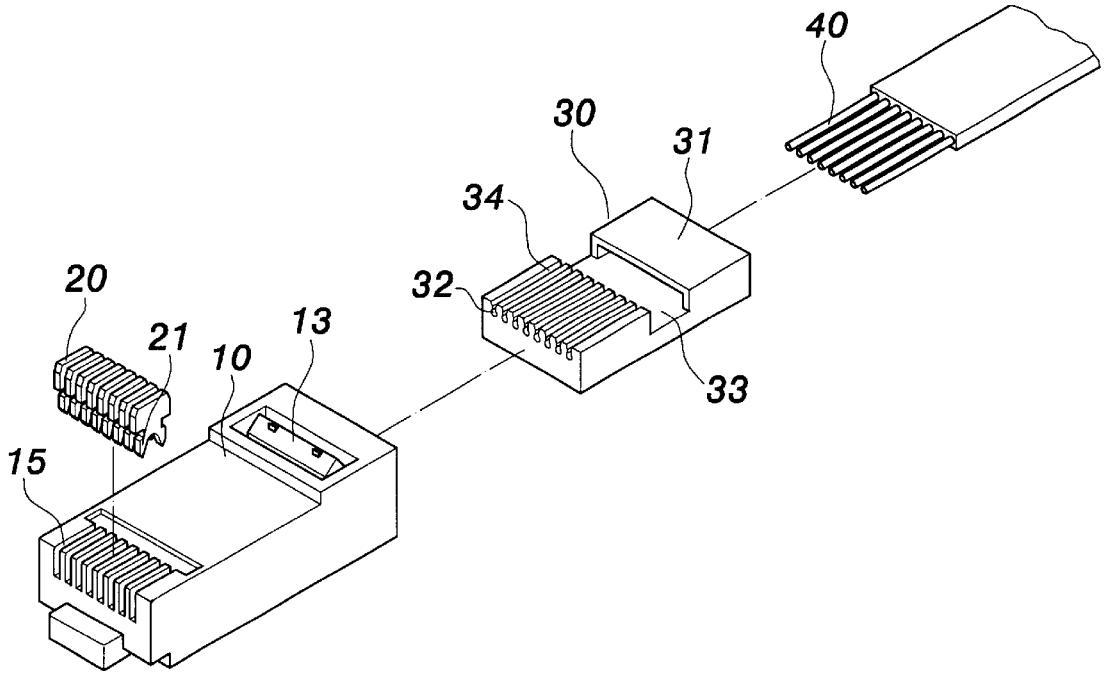
FIG. 4 is a further exploded perspective view of the present invention.
Figure 5:
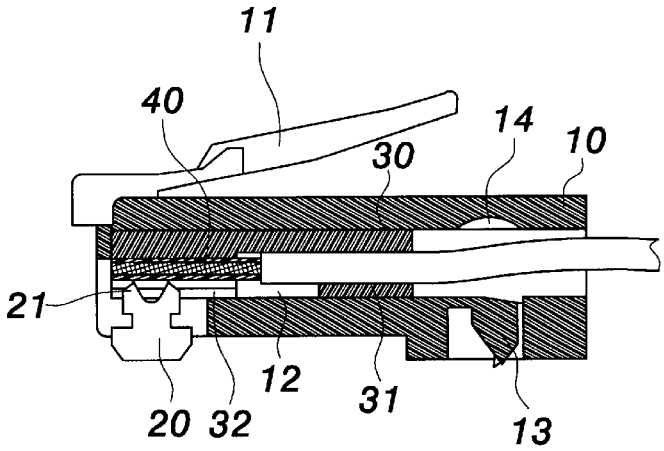
FIG. 5 is a respect cross sectional view of the present invention.
Figure 6:
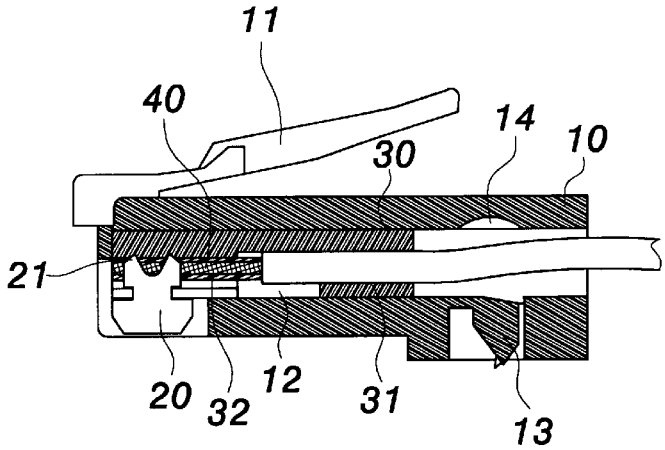
FIG. 6 is a second cross sectional view of the present invention.

Referring to FIGS. 2 to 8, a preferred embodiment about the receptacle of the present invention is illustrated. The receptacle includes a main body 10, a plurality of terminals 20, a connector 30 and a plurality of leads 40.

The main body 10 is made of plastics and insulating materials. An elastic element 11 is installed at a top thereof. A receiving chamber 12 with an opening at the rear end is mounted within the main body 10. Near the rear end of the receiving chamber 12 is installed with a positioning groove 14 at position with respect to the buckle 13. The front end of the main body 10 is installed with a plurality of terminal grooves 15. The terminal grooves 15 are arranged with an equal space and are installed in the main body 10. The terminal grooves 15 are communicated with the receiving chamber 12.

The terminal 20 is made of copper and other conductive material. The terminals 20 are installed in the terminal grooves 15. Each terminal 20 has a respective pierce end 21 for being electrically connected the lead 40.

The connector 30 is made of plastics and other insulated material. The rear side of the connector 30 is a hollow cover 31. The front end and rear end of the hollow cover 31 are opened for being inserted by leads 40. The front end of the connector 30 is installed with a plurality of wire grooves 32. A hollowed portion is installed between the wire grooves 32 and the hollow cover 31. The wire grooves 32 are spaced with an equal space and are installed on the hollow cover 31. The lateral wall of each wire groove 32 is opened. Each of two sides of the opening is installed with a guide tilt surface 34. The lateral side of the wire groove 32 is installed with a narrow groove 35 the width of which is slight smaller than the inner diameter of the wire groove 32. Furthermore, referring to FIG. 8, the connector 30 may has a longer length.

The lead 40 is inserted into the hollow cover 31 of the connector 30, so that the lead 40 passed through the hollow cover 31 and the hollow portion 33. Then, the lead 40 enters into a wire groove 32 through the narrow groove 35 at a lateral wall of the wire groove 32 so that the lead 40 is connected to the connector 30 in advance (referring to FIG. 3), and then the connector 30 is inserted from the rear end of the receiving chamber 12 of the main body 10. The connector 30 serves to drive the lead 40 to insert into the inner front end of the main body 10 and the connector 30 is engaged in the receiving chamber 12 of the main body 10 (referring to FIG. 10). Then the terminals 20 are pressed into the terminal grooves 15. The pierce ends 21 of the terminals 20 are used to pierce into the leads 40 so that the terminals 20 are electrically connected to the conductor in the leads 40 (referring to FIG. 6).

Figure 7:
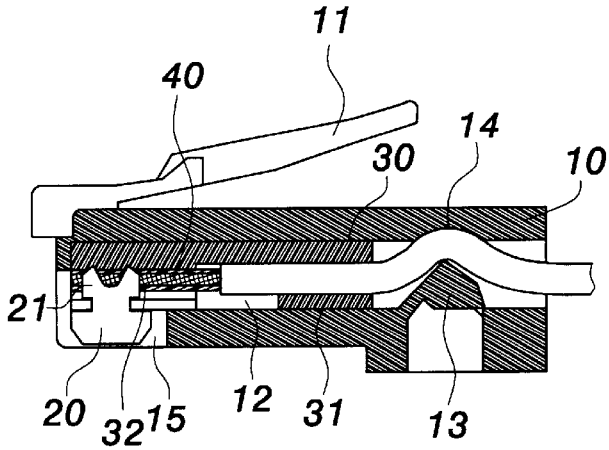
FIG. 7 is a third cross sectional view of the present invention.
Figure 8:
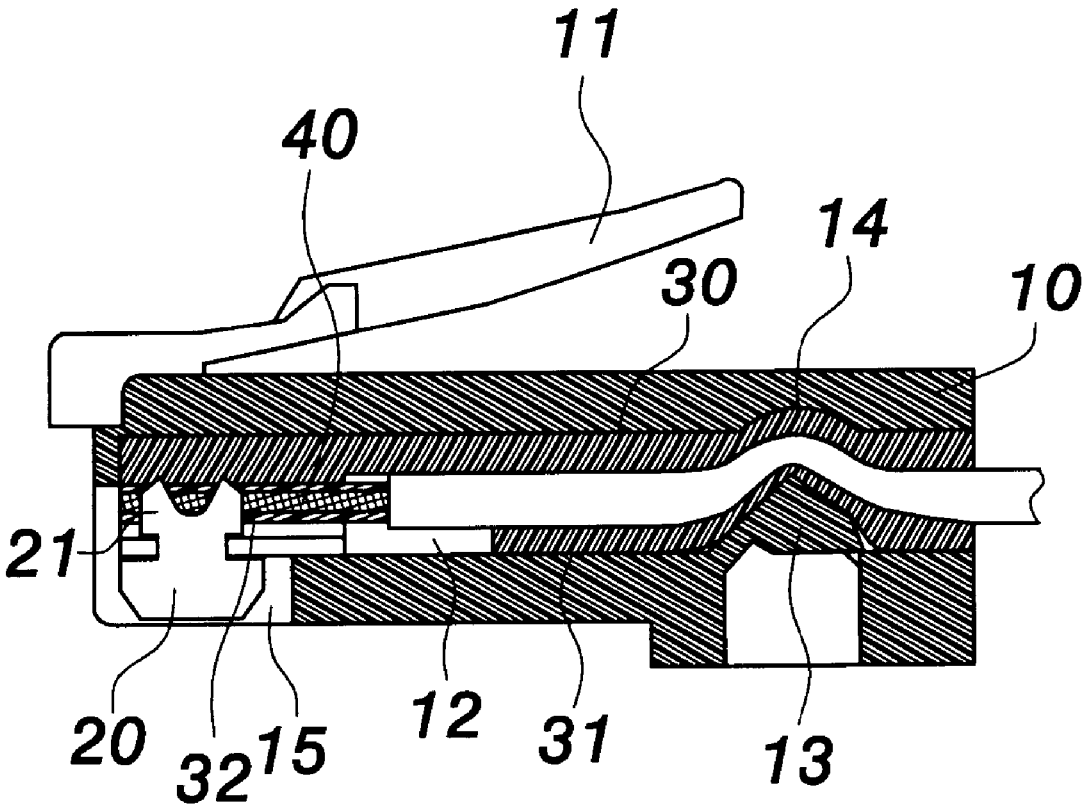
FIG. 8 is a cross sectional view of another embodiment in the present invention.

To cause the lead 40 to be secured within the receiving chamber 12 of the main body 10 firmly, the buckle 13 can be pushed inwards so that the buckle 13 push the respective portion of the leads 40 (referring to FIG. 7). Therefore, leads 40 may be firmly secured between the buckle 13 and the positioning groove 14. Furthermore, a part on the lead 40 with respect to the buckle 13 and the positioning groove 14 is deformed so that the lead 40 does not release from the main body 10 and the connector 30.

In the present invention, the lead 40 is connected to the connector 30 in advance since the lead 40 is connected to the connector 30 out of the main body 10. Furthermore, the lateral wall of the wire groove 32 of the connector 30 has an opens and are installed with guide tilt surfaces 34, therefore, the lead 40 may be placed in the wire groove 32 from the opening at the lateral wall of the wire groove 32. Then, the connector 30 drives the lead 40 to insert into the main body 10 so as to be electrically connected to the terminal 20. By the special design of the present invention, the assembly and operation are easy with less labor and time so that the receptacle can be assembled successfully, and thus the manufacturing cost is reduced effectively and thus is economical. Furthermore, the opening at the lateral wall of the wire groove 32 is installed with a narrow groove 35. The width of the narrow grove is slightly smaller than the inner diameter of the wire groove 32 and the outer diameter of the lead 40. Therefore, after the lead 40 is placed in the wire groove 32, the lead 40 is prevented from released from the wire groove 32.

Figure 9:
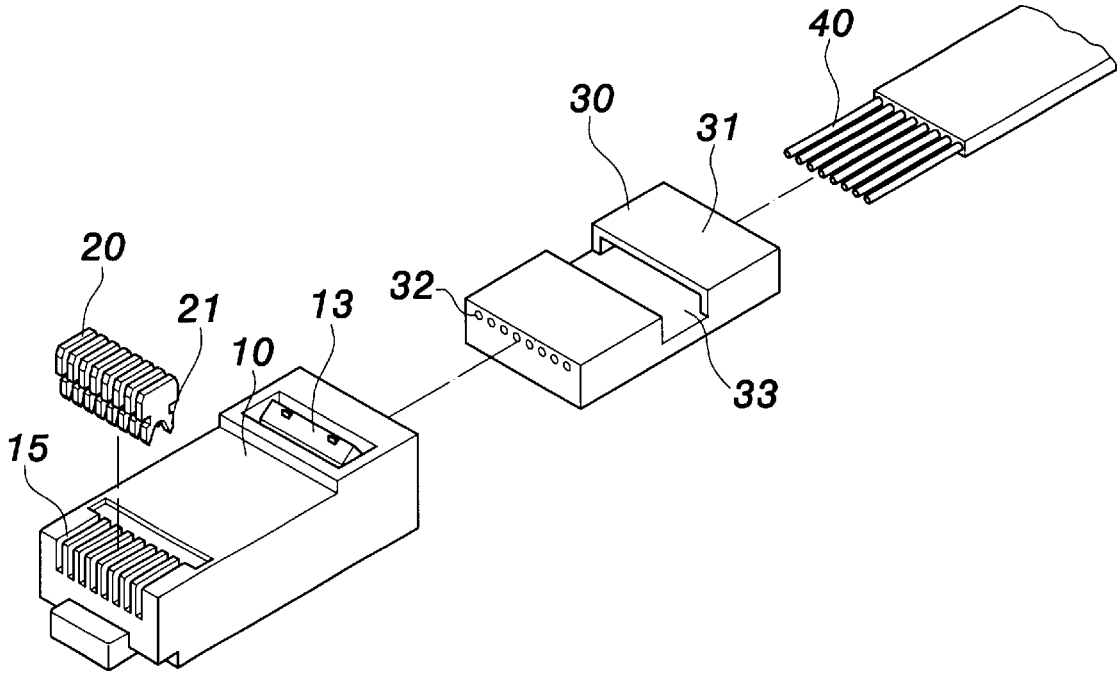
FIG. 9 is an exploded perspective view of a further embodiment in the present invention.
Figure 10:
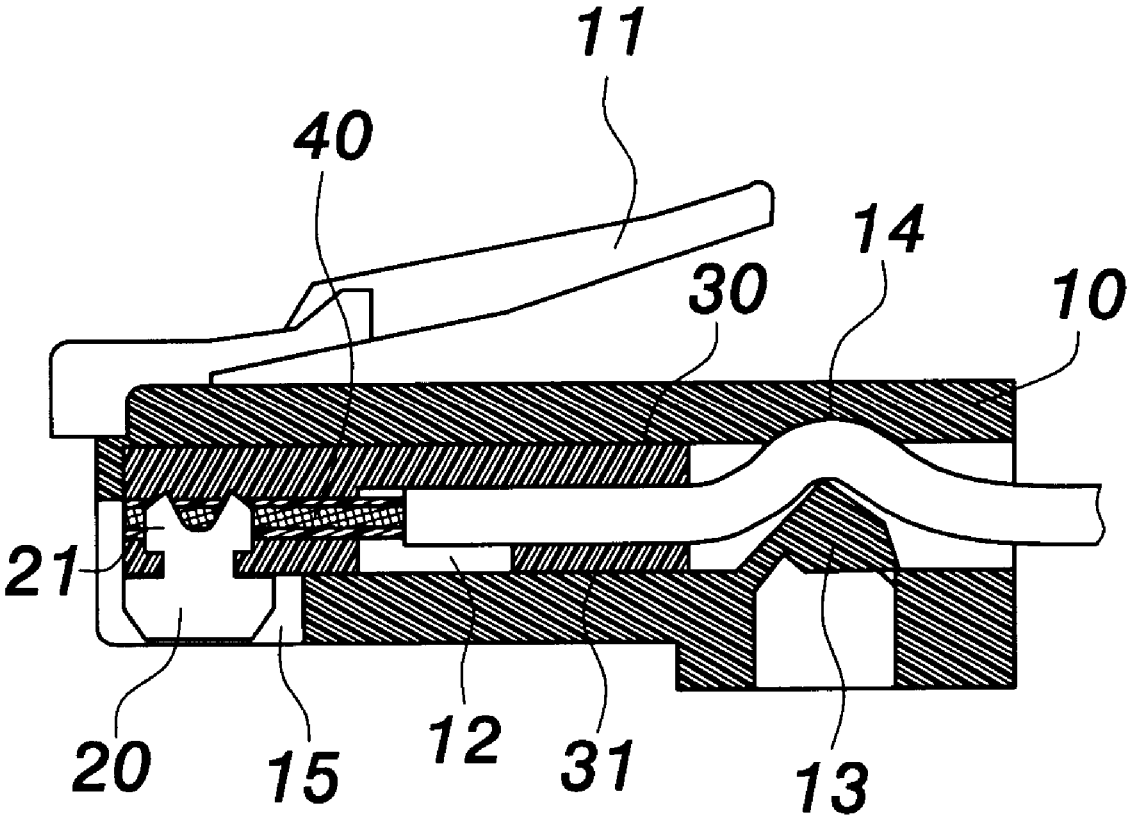
FIG. 10 is a cross sectional view of a further embodiment in the present invention.

Moreover, referring to FIGS. 9 and 10, the wire grooves 32 at the front end of the connector 30 may be designed as a round hole. Only the front end and rear end are formed with openings. Therefore, the leads 40 are inserted into the wire grooves 32 from the rear end of the wire grooves 32 so that the leads 40 are connected to the connector 30 in advance. Then, the connector 30 is inserted from the rear end of the receiving chamber 12 of the main body 10 so that the connector 30 is buckled and fixed to the receiving chamber 12 of the main body 10. Then, the terminals 20 are pressed into the terminal grooves 15. The pierce ends 21 of the terminals 20 pierce into the leads 40 and thus, the terminals 20 are electrically connected to the inner conductor of the leads 40.

Therefore, the present invention has improved the prior art receptacle. In the prior art, the leads are inserted from the rear end so that the leads are inserted into the grooves in the connector. Since the connector is fixed in the inner deep portion of the main body and the leads are made of slender and soft material. It is very hard to align the lead and the wire groove in the connector. As a result, the assembly work is inconvenient. However, this prior art defect has been improved by the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An assembly for receptively terminating a cable having a plurality of cable leads comprising:

a main body having a rear opening formed therein and a receiving chamber extending inward therefrom, said main body having a plurality of longitudinally extending terminal grooves formed at a front end thereof and each communicating with said receiving chamber;

a connector coupled in releasably locked manner to said main body, said connector including (a) a rear portion having a rear passage for receiving the cable leads therethrough and a hollow cover extending from a rearmost end of said connector over said rear passage, (b) a front portion having a plurality of transversely open channels formed therein, each of said open channels defining a longitudinally extended wire groove part for coaxially engaging at least a portion of one cable lead, each said transversely open channel including an upper part forming a slotted opening communicating with said wire groove part, said upper part defining a pair of inclined guiding surfaces about said slotted opening for guiding transverse entry of one said cable lead therethrough into said wire groove part, and (c) an uncovered portion extending between said rear and front portions, said uncovered portion being in open communication with said rear passage and said plurality of open channels to thereby provide access to said plurality of cable leads for respectively installing said cable leads in said plurality of open channels; and, a plurality of terminals each engaging one said terminal groove of said main body and passing into a corresponding one of said open channels, each said terminal having a piercing end for conductively contacting respective one of the cable leads.

2. The assembly as recited in claim 1, wherein said inclined guiding surfaces of each said transversely open channel upper part each describe a downward flare to define for said slotted opening lesser in minimum width than a diametric dimension of said wire groove part.

3. The assembly as recited in claim 1 wherein said main body includes a positioning groove communicating with said receiving chamber, and a resilient buckle extending into said receiving chamber, said buckle being deflectable to capture against said positioning groove a portion of at least one said lead disposed in said receiving chamber.

4. An assembly for receptively terminating a cable having a plurality of cable leads comprising:

a main body having a rear opening formed therein and a receiving chamber extending inward therefrom, said main body having a plurality of longitudinally extending terminal grooves formed at a front end thereof and each communicating with said receiving chamber;

a connector coupled in releasably locked manner within said receiving chamber of said main body, said connector including (a) a rear portion having a rear passage for receiving the cable leads therethrough and a hollow cover extending from a rearmost end of said connector over said rear passage, (b) a front portion having a plurality of longitudinally extended wire grooves formed therein for coaxially receiving respective ones of the cable leads, and (c) an intermediate portion extending between said rear and front portions, said intermediate portion defining a flat planar surface having an open top and being in open communication with said rear passage and said plurality of wire grooves, said open top providing access to said plurality of cable leads for respectively installing said cable leads in said plurality of wire grooves; and a plurality of terminals each engaging one said terminal groove of said main body and passing into a corresponding one of said wire grooves, each said terminal having a piercing end for conductively contacting one of the cable leads.

* * * * *